US006270279B1

(12) United States Patent
Whaley

(10) Patent No.: US 6,270,279 B1
(45) Date of Patent: Aug. 7, 2001

(54) RING BINDER MECHANISM

(75) Inventor: Paul Whaley, Jefferson, MO (US)

(73) Assignee: U.S. Ring Binder L.P., St. Louis, MO (US)

( * ) Notice: Subject to any disclaimer, the term of this patent is extended or adjusted under 35 U.S.C. 154(b) by 0 days.

(21) Appl. No.: 09/645,698

(22) Filed: Aug. 18, 2000

(51) Int. Cl.[7] ..... B42F 13/20

(52) U.S. Cl. ..... 402/38; 402/39; 402/41; 402/36; 402/31; 402/26

(58) Field of Search ..... 402/26, 31, 36–42, 402/2, 52, 54, 70, 73

(56) References Cited

U.S. PATENT DOCUMENTS

| | | | | |
|---|---|---|---|---|
| 5,116,157 | | 5/1992 | Gillum et al. | 402/38 |
| 5,180,247 | * | 1/1993 | Yu | 402/36 X |
| 5,332,327 | | 7/1994 | Gillum | 402/31 |
| 5,348,412 | | 9/1994 | Fuller | 402/75 |
| 5,476,335 | | 12/1995 | Whaley | 402/26 |
| 5,810,500 | | 9/1998 | Whaley | 402/31 |
| 5,816,729 | | 10/1998 | Whaley | 402/31 |
| 5,879,097 | * | 3/1999 | Cheng | 402/36 X |
| 5,957,611 | | 9/1999 | Whaley | 402/31 |
| 6,146,042 | * | 11/2000 | To et al. | 402/36 X |

* cited by examiner

*Primary Examiner*—Willmon Fridie, Jr.
(74) *Attorney, Agent, or Firm*—Polster, Lieder, Woodruff & Lucchesi, LC

(57) ABSTRACT

An improved ring binder (28) comprises a frame (F') having a pair of leafs (L1', L2') extending lengthwise of the frame. Binder rings (R) are each formed of two binder ring halves (R1, R2) one end (E) of each of which is attached to one of the leafs. Boosters (10) are attached to each end of the frame, and the leafs each include a notch (24, 26) formed at their respective ends. Each booster includes a tang (12) captured in the notch. A cover or shield (40) fits over the frame and extends beyond the location of the boosters. The sides of the cover are now crimped about the boosters to secure them in place.

14 Claims, 2 Drawing Sheets

RING BINDER MECHANISM

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to ring binders, and more particularly, to an improved ring binder having pinched ends and in which the booster is better secured to the end of the ring binder than has been previously possible.

In conventional ring binders, a frame portion of the binder comprises a pair of parallel extending plates or leafs to which one end of a binder ring half is attached. A trigger piece commonly referred to as a "booster" is attached at each end of the frame. The booster acts as a lever and provides a camming action by which a person pressing on the booster can moves the plates to open and close the binder rings and hence the binder.

A cover or shield fits over the frame to hide the frame and provide a cosmetic appearance to the binder mechanism. At each end of the cover is an inset through which a tab portion of the booster extends. After the booster is set in place, the sides of the cover extending past the booster are pinched together to hold the booster in place. A problem with this construction is that the pinched-in portions of the cover can be spread apart. Usually this results when the binder is dropped or otherwise mistreated or misused. This creates a space by which the booster can separate from the rest of the frame assembly, fall out of the binder, and render the render useless. The improved construction disclosed herein alleviates this problem.

BRIEF SUMMARY OF THE INVENTION

Among the several objects of the present invention may be noted the provision of an improved ring binder construction particularly a pinched end binder ring;

- the provision of such a construction by which boosters mounted at the ends of a frame assembly are held in place even if the pinched ends of a cover portion of the assembly spread apart;
- the provision of such a construction to employ a notched end leaf with a tang portion of the booster being captured in the notch so to remain attached to the frame assembly;
- the provision of such a construction in which identical portions of the notch are formed at each end of each leaf;
- the provision of such a construction in which each portion of each notch includes an inner wide section, and an outer lead section which is narrows the width of the notch, the lead sections of the notch being deformable by an assembler inserting the tang portion of the binder to the frame assembly to force the tang into the notch;
- the provision of such a construction in which leaf is formed of a spring material so the leads return to their initial configuration once the booster tang is installed;
- the provision of such a construction to employ a cover or shield the length of which is such that the cover extends beyond the installed boosters;

- the provision of such a cover whose ends are deformable about the boosters by pinching or crimping so to further lock the boosters in place and prevent the boosters from being dislodged during use of the binder; and,
- the provision of such a construction which is readily adapted to current binder assembly methods so to facilitate manufacture of improved binders without increasing the cost of a binder.

In accordance with the invention, generally stated, an improved ring binder comprises a frame including a pair of leafs extending lengthwise of the frame. A series of binder rings are each formed of two binder ring halves one end of each of which is attached to one of the leafs. A booster is attached at each end of the frame. The leafs each include a notch formed at each end thereof and the boosters each include a tang captured in the respective notches. A cover or shield fits over the frame and the length of the cover is such that it extends beyond the location of the respective boosters when they are mounted in place. The sides of the cover are crimped about the boosters to secure them in place. Other objects and features will be in part apparent and in part pointed out hereinafter.

BRIEF DESCRIPTION OF THE SEVERAL VIEWS OF THE DRAWINGS

In the drawings.

Corresponding reference characters indicate corresponding parts throughout the drawings.

DETAILED DESCRIPTION OF THE INVENTION

Figure 1:
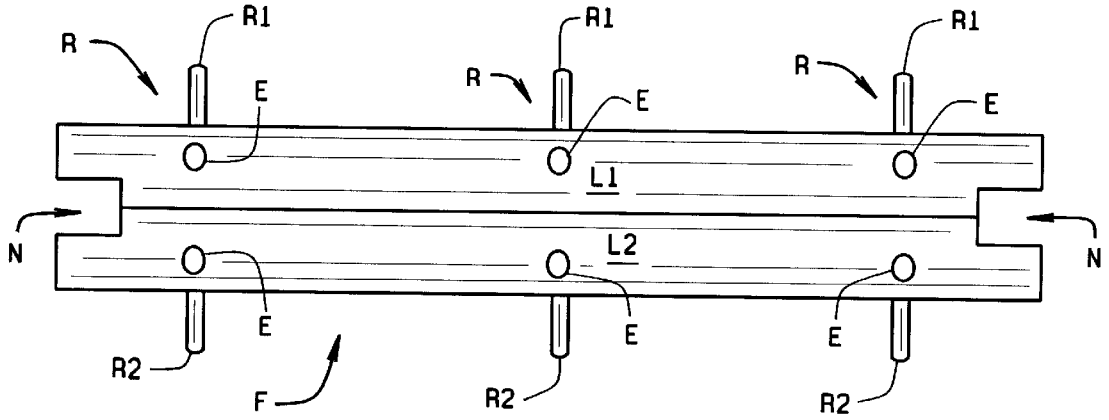
FIG. 1 PRIOR ART
FIG. 1 is a plan view of prior art leaf constructions used to form a frame assembly.
Figure 2:
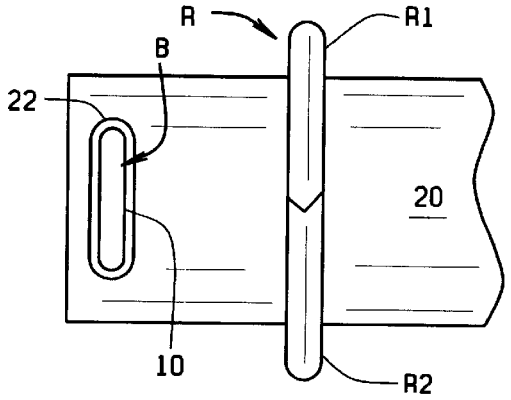
FIG. 2 PRIOR ART
FIG. 2 is a partial plan view of a prior art binder made using the leaf construction of FIG. 1.
Figure 3:
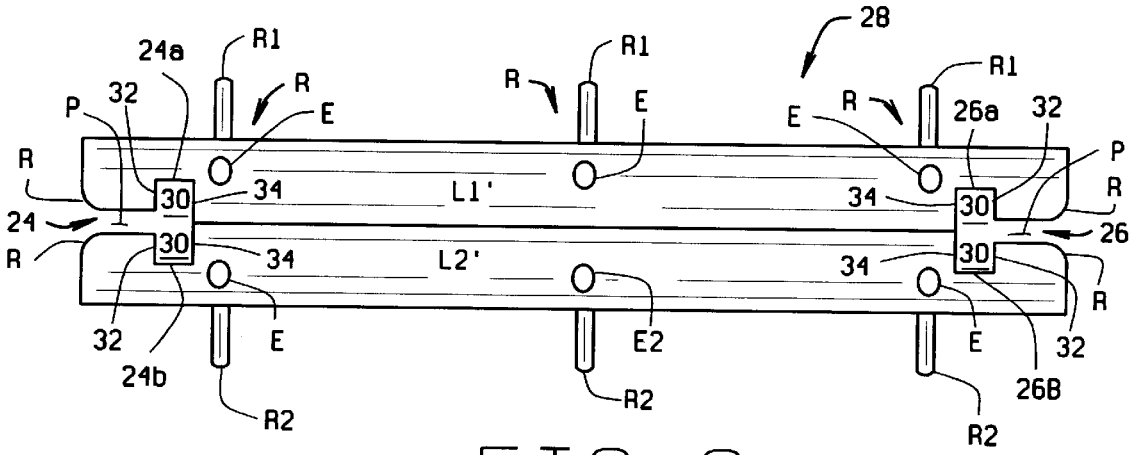
FIG. 3 is a plan view of leafs used in a frame assembly for the improved ring binder of the present invention.
Figure 4A:
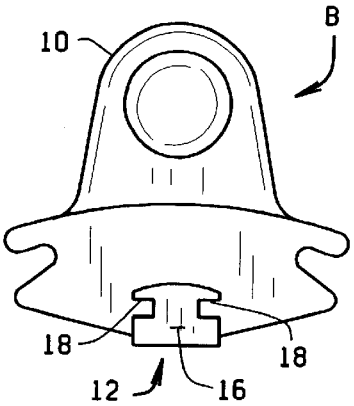
FIGS. 4A and 4B are respective front and side elevational views of a booster used in the binder.
Figure 4B:
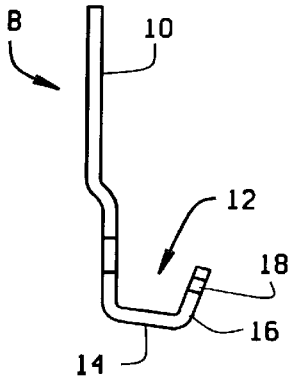
Figure 5:
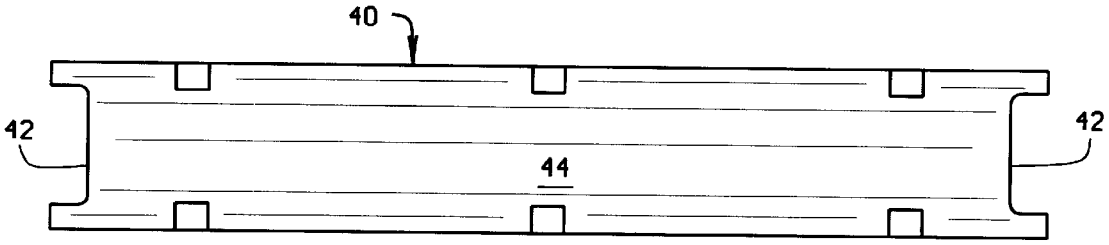
FIG. 5 is a plan view of a cover or shield used in the binder.
Figure 6:
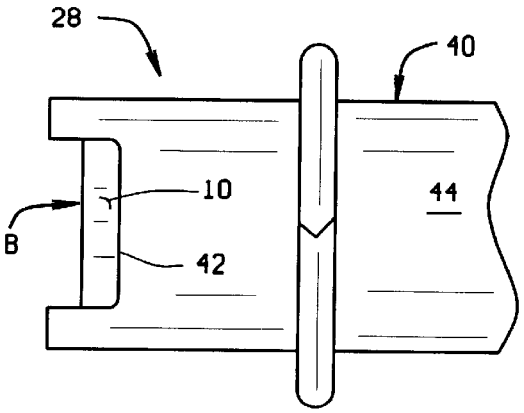
FIG. 6 is a top plan view of the completed improved binder.

Referring to the drawings, FIGS. 1 and 2 illustrate a prior construction of a ring binder in which a frame F portion of the binder includes a pair of leafs L1 and L2 which comprise rectangular plates extending the length of the frame generally parallel to each other. Binder rings R are located at spaced intervals along the length of the frame. Each ring comprises two ring halves R1 and R2 one end E of each ring half is attached to a respective one of the leafs. At each end of the leafs, notches N are formed, the notches extending inwardly into the leaf. The respective notches are uniform in width throughout their length. A booster B (see FIGS. 4A and 4B) has an upright elongated finger pad 10 for a user to manipulate the booster. A tang 12 extends inwardly from the base of pad 10 when the booster is installed. Tang 12 first includes a generally diagonally extending arm 14. At the distal end of arm 14, a second arm 16 extends diagonally upwardly. Inwardly extending slots 18 extend into the body of this arm at the upper end of arm 16. While the overall width of booster arms 14, 16 is greater than the width of the notches formed at the ends of the leaf, the distance between the inner ends of the slots 18 is less than the width of a notch. The slots thus allow the booster to be inserted into a notch N because the sides of the notch fit in the slots 18. As result, when the boosters are in place, arm 14 of the booster fits below the leafs; while the outer end of arm 16 extends above the leafs. This, as is well-known in the art provides a camming action when the booster is pressed upon so to pivot the leafs and open or close the binder rings.

To prevent a booster from being extracted from a notch, a cover or shield 20 has a transverse slot 22 formed adjacent each end. The width of slot 22 is greater than the width of pad 10. When the ring binder is assembled, the cover is fitted so the slots 22 fit over the booster. The material between the outer edge of the slot and the adjacent end of the cover is now bent to help attach the cover to the frame and hold the boosters in place.

An improved ring binder of the present invention is indicated generally 28 and first includes a frame F' having a pair of leafs L1' and L2' extending lengthwise of the frame. At least one and preferably a series of binder rings R are spaced along the length of the frame. Again, each ring R is formed of two binder ring halves R1 and R2; and again, one end E of each ring of which is attached to one. A booster B formed as previously described is attached to the leafs at each end of the frame.

In accordance with the invention, the leafs each include a notch 24, 26 formed at their respective ends for capturing the tangs 12 of the boosters. A portion of each notch is formed in each leaf L1', L2' with notch portions 24*a*, 26*a* formed at the ends of leaf L1', and portions 24*b*, 26*b* at the ends of leaf L2'. The notch portions formed on each leaf are identical in size and shape. The inner end 30 of each portion is of a generally rectangular shape. An outer edge 32 of inner end 30 does not extend as far from the inner extent of the body of the leaf as does the inner edge 34 thereof. Rather, this edge extends only approximately 75% of the distance as the inner edge. When the two leafs are therefore placed side-by-side to form frame F' of the assembly, a narrow passage P is formed which extends inwardly from the end of the leafs and opens into inner 30 of the respective notch. The outer end of this passage, the end adjacent the end of the leaf, is radiused as indicated at R to form a lead for inserting booster tang 12 into the notch. This is because the overall width of passage P is now less than the distance between the inner ends of the slots 18 formed in arm 16 of the booster. What the radiused outer end of the passage provides is the flexibility that the allows the sides of the passage to curl away from arm 16 of the booster as it is inserted into the notch. Since the leafs are of a spring material, they not only fold back as the booster is fitted to the frame, but immediately return to their original position when the booster is in place. It will be noted that outer 32 of the inner end of the notch is at a right angle to the inner end of the passage. This prevents the booster from being pulled back out the passage to extract it from the notch.

Figure 7:
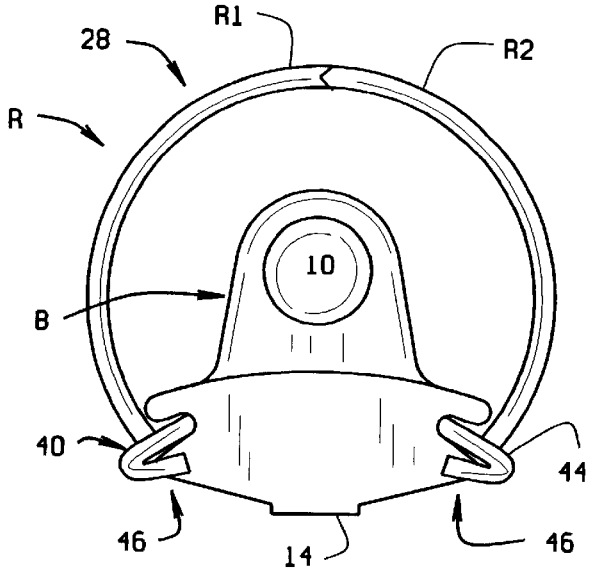
FIG. 7 is an end elevational view thereof.

A cover or shield 40 fits over the frame/booster assembly. The length of cover 40 is such that it extends beyond the end of the leafs and the booster when fitted over the binder rings. A recess 42 is formed at each end of the cover and the respective boosters fit in this recess when the cover is installed. As shown in FIG. 7, top 44 of the cover is curved and the cover has inwardly extending flanges 46 which extend beneath the outer edges of the respective leafs L1', L2'. The sides of the cover formed by this horizontal V shape configuration are now deformed by crimping or pinching the cover as indicated at 46 in FIG. 7. In deforming the sides of the cover, some of the crimped material pinches in behind the outer end of the boosters to lock the booster in place. This, in combination with notch configuration above described now makes it very difficult to dislodge the booster and render a binder useless, regardless of the rough treatment to which the binder is subjected.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

What is claimed is:

1. An improved ring binder comprising:

a frame including a pair of leafs extending lengthwise of the frame;

at least one binder ring formed of two binder ring halves one end of each of which is attached to one of the leafs;

a first booster attached to one end of the frame, the leafs each including a notch formed at the same end thereof and the booster including a tang captured with the notch for the booster to be able to move the leafs relative to each other to open and close the binder, and a second booster installed at the other end of the frame, the leafs including another notch formed at the other end of the frame and each end of the cover respectively extending beyond an installed booster and crimped about the booster to secure the booster in place; and, a cover fitting over the frame and extending beyond the location of the booster when it is attached to the frame, sides of the cover being crimped about the booster to secure the booster in place, and wherein the notches formed by the leafs each include an inner end and an outer end with a passage formed between the notch and an adjacent end of the leafs, the inner end of a respective notch and its associated passage being narrower than the booster tang.

2. The improved ring binder of claim 1 wherein the tang has slots formed therein and extending inwardly from the sides of the tang, the width of the tang between the inner end of the slots being less than the width of the inner end of the notch and greater than the width of the passage.

3. The improved ring binder of claim 2 wherein the outer end of the passage has a radiused edge along each side thereof comprising a flexible lead by which the booster tang is inserted into the notch, the lead being deformed by insertion of the tang into the slot, but the material from which the leafs are formed being sufficiently flexible for the leaf to return to its initial position when the tang reaches the inner end of the notch.

4. The improved ring binder of claim 3 the outer edge of the inner end of the notch and the inner end of the passage are at a right angle to each other so to prevent the tang from being pulled back out the passage.

5. The improved ring binder of claim 4 wherein the cover has a recess formed at an end thereof and the booster fits in a recess formed at the end of the cover.

6. The improved ring binder of claim 5 wherein sidewalls of the cover about the recess are deformed about an outer end of the booster, after the booster is installed, to hold the booster in place.

7. In a ring binder having a frame including a pair of leafs extending lengthwise of the frame and at least one binder ring formed of two binder ring halves one end of each of which is attached to one of the leafs, the improvement comprising;

a booster attached to one end of the frame, the leafs each including a notch formed at the same end thereof and the booster including a tang captured with the notch for the booster to be able to move the leafs relative to each other to open and close the binder, the notch formed by the leafs including an inner end and an outer end with a passage formed between the notch and an adjacent end of the leafs, the inner end of the notch and the passage being narrower than the booster tang.

8. The improvement of claim 7 further including a second booster including a booster tang installed at the other end of the frame with the leafs including another notch formed at said other end of the frame, said another notch also including an inner end and an outer end with a passage formed therebetween, the inner end of said another notch and its associated passage being narrower than the booster tang of said second booster.

9. The improvement of claim 8 further including a cover fitting over the frame and extending beyond the location of the boosters when they are attached to the frame, sides of the cover being crimped about the boosters to secure the boosters in place.

10. The improvement of claim 8 wherein each booster tang has slots formed therein and extending inwardly from the sides of the tang, the width of the tang between the inner end of the slots being less than the width of the inner end of the notch and greater than the width of the passage.

11. The improvement of claim 10 wherein the outer end of each passage has a radiused edge along each side thereof comprising a flexible lead by which a booster tang is inserted into the notch, the lead being deformed by insertion of the tang into the slot, but the material from which the leafs are formed being sufficiently flexible for the leaf to return to its initial position when the tang reaches the inner end of the notch.

12. The improvement of claim 11 the outer edge of the inner end of the notch and the inner end of the passage are at a right angle to each other so to prevent the tang from being pulled back out the passage.

13. The improvement of claim 9 wherein the cover has a recess formed at an end thereof with a booster fitting in the recess.

14. The improvement of claim 13 wherein sidewalls of the cover about the recess are deformed about an outer end of a booster, after the booster is installed, to hold the booster in place.

* * * * *